US007464677B2

(12) United States Patent
Neal et al.

(10) Patent No.: US 7,464,677 B2
(45) Date of Patent: Dec. 16, 2008

(54) COMPACT LASH ADJUSTER FEED CHANNEL APPARATUS

(75) Inventors: Timothy L. Neal, Ortonville, MI (US); Vimesh M. Patel, Novi, MI (US); Craig D. Marriott, Clawson, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 211 days.

(21) Appl. No.: 11/434,381

(22) Filed: May 15, 2006

(65) Prior Publication Data

US 2007/0261652 A1 Nov. 15, 2007

(51) Int. Cl.
*F01L 1/14* (2006.01)

(52) U.S. Cl. ..... 123/90.48; 123/90.16; 123/90.43

(58) Field of Classification Search ..... 123/90.52, 123/90.43–90.46, 90.16, 90.48, 90.27, 90.5
See application file for complete search history.

(56) References Cited

U.S. PATENT DOCUMENTS 5,031,586 A * 7/1991 Masuda et al. ..... 123/90.27
7,308,872 B2 * 12/2007 Sellnau et al. ..... 123/90.16
2007/0163523 A1 * 7/2007 Miyazato et al. ..... 123/90.16

* cited by examiner

*Primary Examiner*—Zelalem Eshete

(57) ABSTRACT

The apparatus of the present invention provides a lash adjuster feed channel for an engine assembly. The engine assembly includes first and second sets of hydraulic lash adjusters responsive to a variation in hydraulic fluid pressure to cause a variation in lift of first and second sets of engine valves respectively operatively connected thereto. The cylinder head defines a first feed passage in fluid communication with the first set of hydraulic lash adjusters, and a second feed passage in fluid communication with the second set of hydraulic lash adjusters. The valve lift of the first set of engine valves is independently variable by controlling the transfer of hydraulic pressure in the first feed passage, and the valve lift of the second set of engine valves is independently variable by controlling the transfer of hydraulic pressure in the second feed passage. A corresponding method is also provided.

14 Claims, 4 Drawing Sheets

COMPACT LASH ADJUSTER FEED CHANNEL APPARATUS

TECHNICAL FIELD

The present invention relates to a method and apparatus for transferring hydraulic fluid to a plurality of lash adjusters.

BACKGROUND OF THE INVENTION

Some valve trains are selectively adjustable to vary the amount of valve travel. Typically, such valvetrains are selectively adjustable between a low-lift mode, in which the valvetrain causes an engine valve to open a first predetermined amount, and a high-lift mode, in which the valvetrain causes the valve to open a second predetermined amount that is greater than the first predetermined amount. Alternatively, the low-lift mode may be a zero-lift mode configured to allow valve deactivation.

Selectively adjustable valvetrains may include a plurality of two-step rocker arms that engage an engine valve and are pivotable in response to cam motion to lift the valve. The two-step rocker arm is hydraulically actuatable to engage either the low-lift mode or the high-lift mode. Lash adjusters are used to accommodate for build variation and wear in a valvetrain assembly. Lash adjusters are also typically configured to transfer pressurized hydraulic fluid to actuate the two-step rocker arms and thereby control the engagement of the low-lift and high-lift modes.

Traditionally, the transfer of pressurized fluid to the lash adjusters has been achieved by using a cylinder head having a complex system of fluid supply passages that enable pressurized fluid to communicate with the lash adjusters, which are supported in the cylinder head. Cylinder heads with such an integrated hydraulic system are necessarily specific to each engine family and entail numerous production steps such as casting, boring, and finishing the network of channels provided in the cylinder head. Additionally, packaging the fluid supply passages in the cylinder head is difficult because of the limited available space, and a compact fluid supply passage design is therefore preferable.

SUMMARY OF THE INVENTION

The apparatus of the present invention includes a lash adjuster feed channel for an engine assembly. The engine assembly includes a cylinder head at least partially forming a first and second set of cylinders. First and second sets of hydraulic lash adjusters are operatively connected to the first and second set of cylinders, respectively. The first and second sets of hydraulic lash adjusters are responsive to a variation in hydraulic fluid pressure to cause a variation in lift of first and second sets of engine valves respectively operatively connected thereto. The first and second sets of hydraulic lash adjusters include a body and an inlet portion. The cylinder head defines a first feed passage in fluid communication with the first set of hydraulic lash adjusters. The cylinder head also defines a second feed passage located in close proximity to the first feed passage. The second feed passage is in fluid communication with the second set of hydraulic lash adjusters. The valve lift of the first set of engine valves is independently variable by controlling the pressure of hydraulic fluid in the first feed passage, and the valve lift of the second set of engine valves is independently variable by controlling the pressure of hydraulic fluid in the second feed passage.

The second feed passage may be partially blocked by the first set of hydraulic lash adjusters such that hydraulic fluid transferred through the second feed passage engages the body of the first set of hydraulic lash adjusters without entering the inlet portion of the first set of hydraulic lash adjusters.

The cylinder head may further define a plurality of short passages or worm tracks disposed between the second feed passage and the inlet portion of the second set of hydraulic lash adjusters to establish fluid communication therebetween.

The present invention also provides a compact method for independently controlling the valve lift of a first and second set of engine valves. The method includes providing first and second sets of hydraulic lash adjusters operatively connected to the first and second set of engine valves. Each of the first and second sets of hydraulic lash adjusters preferably includes a body and an inlet portion. A first predetermined amount of hydraulic pressure is applied to only the first set of hydraulic lash adjusters via a first feed passage to thereby control the valve lift of the first set of engine valves. A second predetermined amount of hydraulic pressure is applied to only the second set of hydraulic lash adjusters via a second feed passage to thereby control the valve lift of the second set of engine valves independently from the valve lift of the first set of engine valves.

The first set of hydraulic lash adjusters may be implemented to partially block the second feed passage such that the hydraulic fluid transferred through the second feed passage engages the body of the first set of hydraulic lash adjusters without entering the inlet portion of the hydraulic lash adjusters thereby allowing the first and second feed passages to be positioned in close proximity to each other, and potentially formed by a single casting core, while retaining independent valve lift control.

The above features and advantages and other features and advantages of the present invention are readily apparent from the following detailed description of the best modes for carrying out the invention when taken in connection with the accompanying drawings.

DESCRIPTION OF THE PREFERRED EMBODIMENTS

Figure 1:
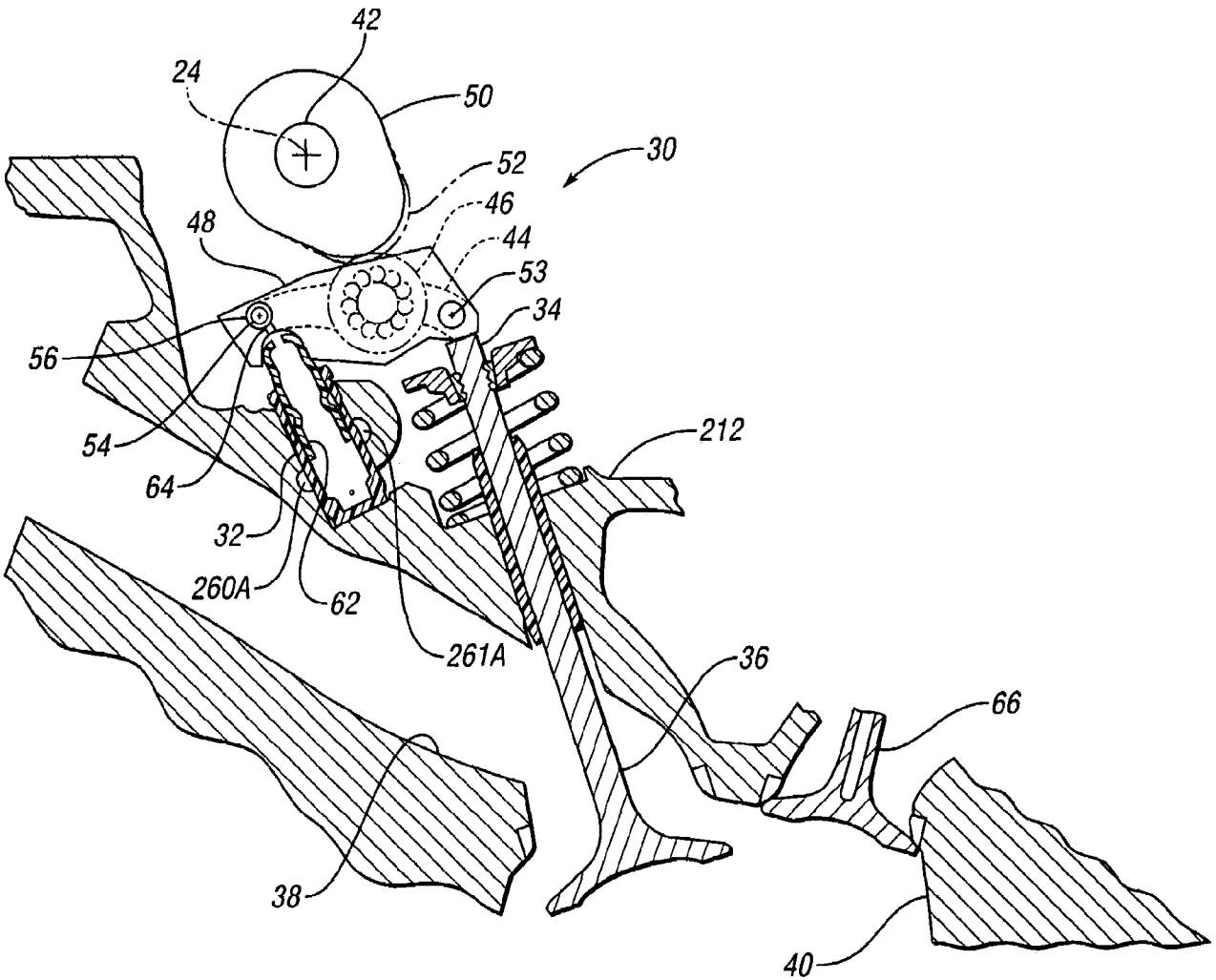
FIG. 1 is a schematic side illustration of a switchable roller finger follower assembly having a hydraulic lash adjuster and an engine valve and hydraulically controllable by the dual independent hydraulic circuit module of FIG. 2.

Referring to FIG. 1, control of an engine valve to provide dual lift will be briefly described. FIG. 1 illustrates a hydraulically actuated switchable roller finger follower ("SRFF") assembly 30, which is supported by a cylinder head 212. The SRFF assembly 30 is pivotally mounted on a hydraulic lash adjuster 32, and contacts the valve stem 34 of an engine inlet valve 36. The engine inlet valve 36 selectively opens and closes an inlet passage 38 to a cylinder 40 which is partially formed by the cylinder head 212. The engine inlet valve 36 is selectively lifted and lowered in response to rotation of an inlet camshaft 42 on which multiple cam lobes are mounted. The inlet camshaft 42 rotates about inlet camshaft axis 24.

The SRFF assembly 30 includes an inner rocker arm 44 which rotatably supports a roller element 46. The inner rocker arm 44 is positioned between outer rocker arms 48, one of which is visible. The other outer rocker arm 48 is positioned on the opposite side of the inner rocker arm 44 and is configured exactly like the rocker arm 48 visible in FIG. 1. A first low lift cam lobe 50 rotates with the camshaft 42 and is in operative contact with the roller element 46 mounted on the inner rocker arm 44. The inner rocker arm 44 is in contact with the valve stem 34. The inner and outer rocker arms 44, 48 are both pivotable about an axis through pivot point 53. The arms 44, 48 may selectively be pivotable relative to one another or connected together for common pivoting about pivot point 53. High lift is provided by selectively pinning the inner arm 44 and the outer arm 46 together for common pivoting about pivot point 53. When the outer rocker arm 48 pivots freely with respect to the inner rocker arm 44, action of the high lift cam lobe 52 on the outer rocker arm 48 does not affect lift of the engine inlet valve 36. Instead, the high lift cam lobe 52 simply causes the outer rocker arm 48 to move relative to the inner rocker arm 44 about the pivot point 53 in "lost motion" without any impact on the lift event of the engine inlet valve 36. Rather, lift of the engine inlet valve 36 is affected only by action of the low lift cam lobe 50 on the roller element 46 as transferred to the engine inlet valve 36 via the inner rocker arm 44, which contacts with valve stem 34.

When high valve lift is desired, the outer rocker arm 48 may be connected for common pivoting with the inner rocker arm 44. When this occurs, the effect of the high lift cam lobe 52 on the outer rocker arm 48 is transferred to the inner rocker arm 44 and to the engine inlet valve 36. Switching between the low lift and high lift event is affected by controlling the hydraulic pressure through the hydraulic lash adjuster 32. The hydraulic lash adjuster 32 is in fluid communication with a pin 54 transversely mounted with respect to the arms 44 and 46. During a low lift event, a relatively low pressure of hydraulic fluid is fed through one or both of the feed passages 260A, 261A to a chamber 62 formed within the hydraulic lift valve 32. The feed passages 260A and 261A are formed or machined within cylinder head 212. The chamber 62 is in fluid communication with a channel 64 which acts upon an inner transverse space of the pin 54. The relatively low pressure is insufficient to actuate the pin 54 outward to be received within a pin bore 56 formed in the outer rocker arm 48. When high valve lift is desired, an electronic control unit (not shown) controls the dual independent hydraulic circuit control module 210 of FIGS. 2 and 3 to increase hydraulic fluid pressure provided in feed passages 260A and/or 261A thereby increasing pressure on the pin 54 sufficiently to actuate it outward to lock the inner rocker arm 44 to the outer rocker arm 48. A SRFF assembly such as the SRFF assembly 30 is discussed in further detail in U.S. Pat. No. 6,769,387, issued Aug. 3, 2004 to Hayman et al., commonly assigned to General Motors Corporation, which is hereby incorporated by reference in its entirety.

Operation of a dual independent hydraulic circuit module 210 to vary the hydraulic fluid pressure within the feed passages 60, 61 is described below. It should be appreciated that the hydraulic circuit control module 210 is shown for illustrative purposes in accordance with a preferred method. Alternatively; however, the hydraulic fluid pressure within the feed passages 60, 61 may be varied in any known manner. It should also be appreciated that the lift control provided by the control module 210 as described with respect to the engine inlet valve 36 is also preferably applied to the exhaust valves such as the exhaust valve 66 shown in FIG. 1.

Figure 2:
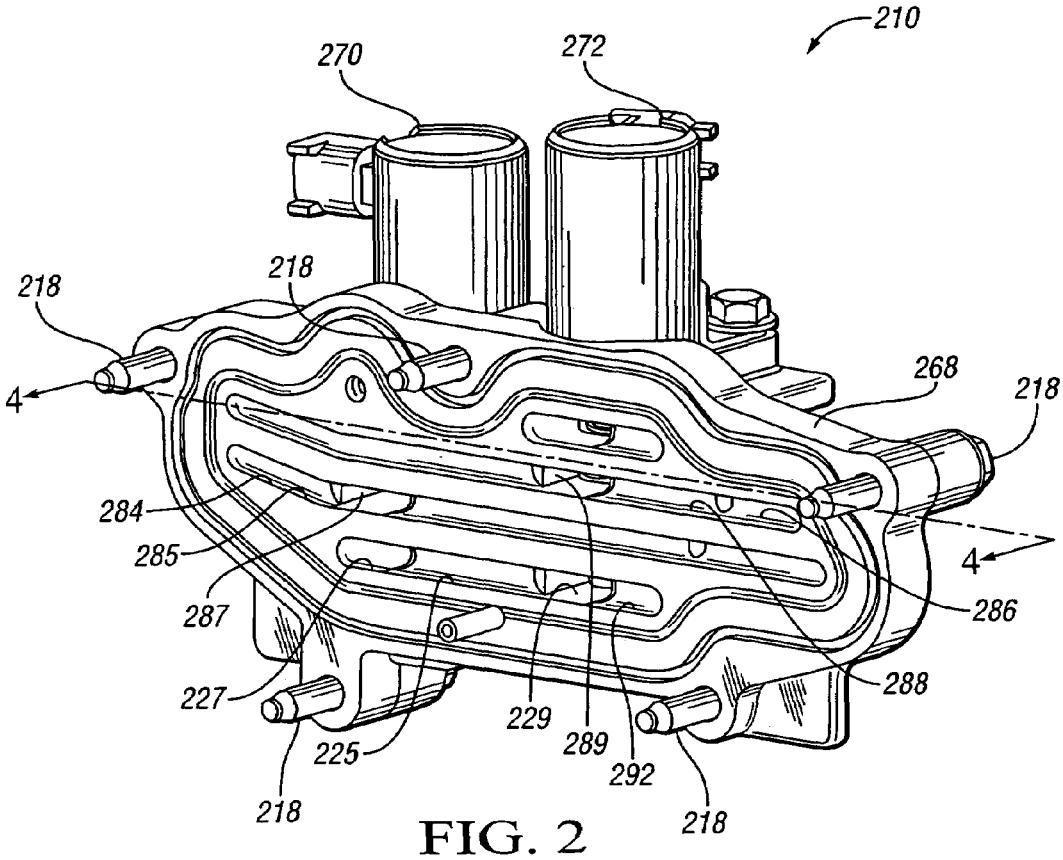
FIG. 2 is a schematic perspective illustration of a dual independent hydraulic circuit module for controlling lift of an engine valve such as that of FIG. 1.
Figure 3:
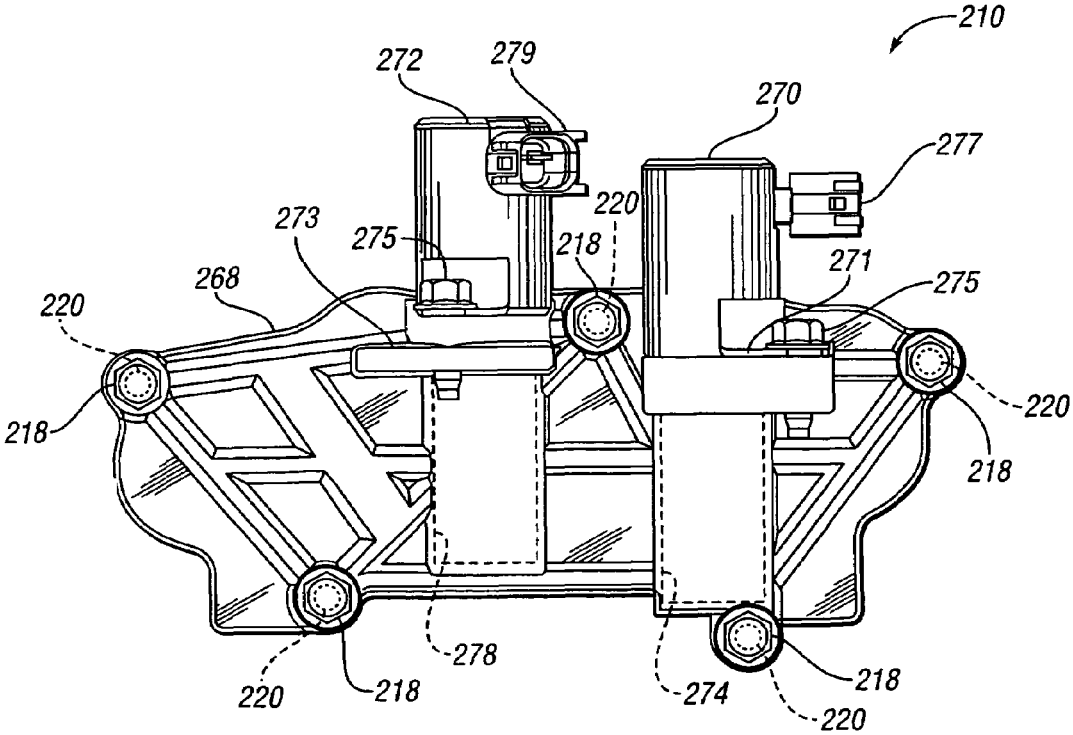
FIG. 3 is a schematic illustration in elevational view of the dual independent hydraulic circuit module of FIG. 2.
Figure 4:
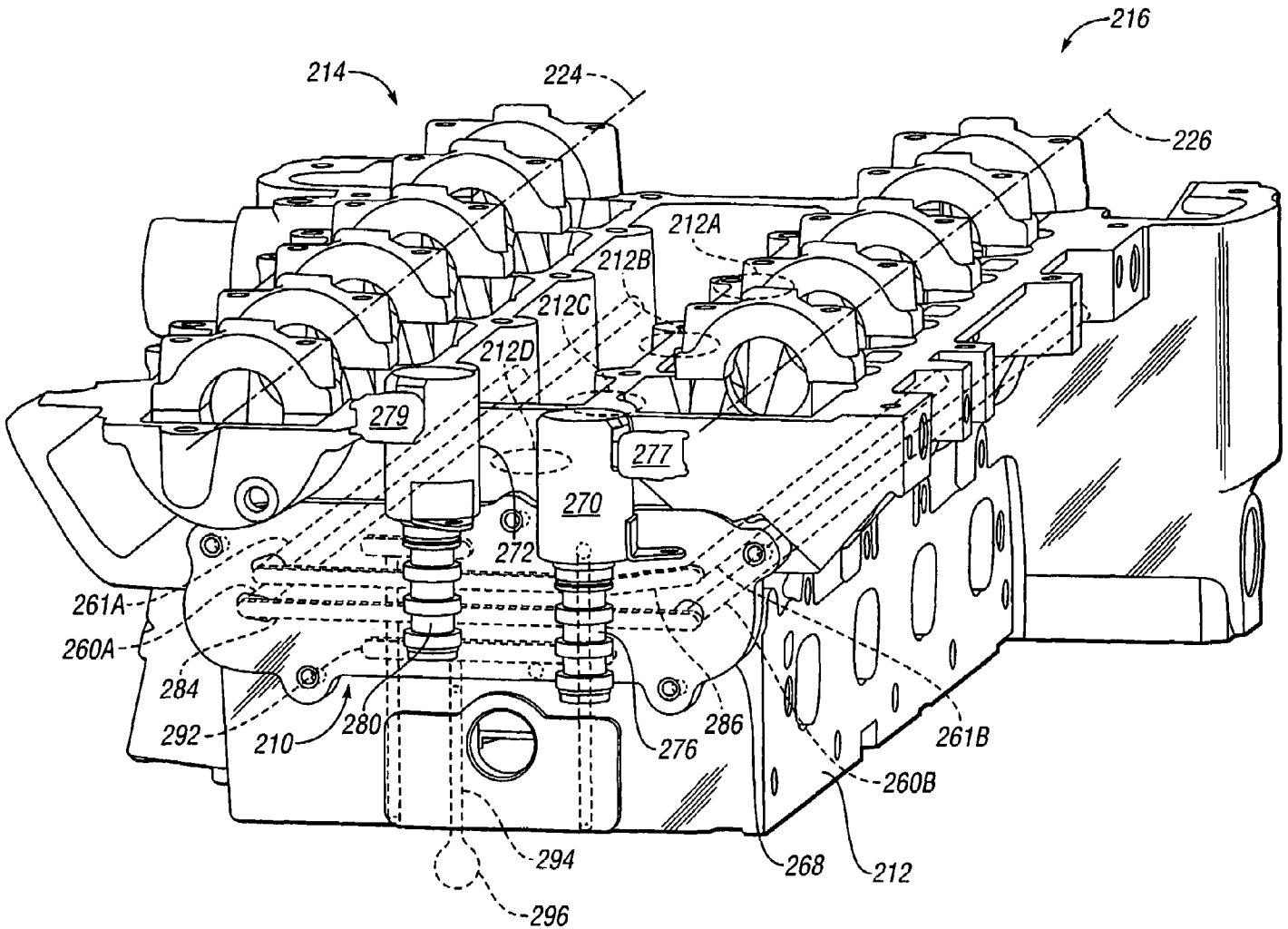
FIG. 4 is a schematic perspective illustration of a portion of an engine assembly having the dual independent hydraulic circuit module of FIGS. 4 and 5 (shown partially in phantom and in cross-section at the arrows shown in FIG. 4) attached at a side surface of a cylinder head.

Referring to FIG. 2, the dual independent hydraulic circuit control module 210 will now be described. The module 210 includes a housing 268 which supports first and second solenoid valves 270, 272, respectively. As shown in FIG. 3, the solenoid valves 270, 272 are supported on first and second flanges 271, 273 of housing 268, which secure the valves 270, 272 via valve bolts 275. The housing 268 also forms first and second chambers 274, 278 respectively. The first chamber 274 houses the first solenoid valve body 276 which is visible in FIG. 4. The second chamber 278 houses the second solenoid valve body 280, also visible in FIG. 4. Referring again to FIG. 3, the housing 268 has bolt openings 220 which allow the housing 268 to be connected to a cylinder head 212 as illustrated in FIG. 4 via bolts 218. When assembled, electrical connector portions 277, 279 of the respective solenoid valves 270, 272 are accessible above the housing 268.

Referring now to FIG. 2, the housing 268 is preferably a cast member that forms a supply passage 292. Supply passage 292 includes a fluid supply channel 225 as well as a first supply aperture 227 and a second supply aperture 229. The supply apertures 227 and 229 extend through the housing 268. Referring to FIG. 4, which shows the housing 268 taken in partial cross-sectional view at the arrows shown in FIG. 4, when the supply module 210 is mounted to the cylinder head 212, the fluid supply passage 292 is in fluid communication with a supply channel 294 in the cylinder head 212 that communicates with a fluid supply gallery 296 in the engine block (not shown) to which the cylinder head 212 is designed to be attached to form a completed engine assembly 216. Thus, fluid is provided through the fluid supply channel 294 to the fluid supply passage 292 and through the respective fluid supply apertures 227 and 229 to the solenoid valve bodies 276 and 280.

Referring again to FIG. 2, the housing 268 also forms a first control passage 284 that includes a first control channel 285 as well as a first control aperture 287. The first control aperture 287 extends through the housing 268 and is in fluid communication with the first chamber 274 (shown in FIG. 3).

The housing 268 also is formed with a second control passage 286 which includes a second control channel 288 as well as a second control aperture 289. The second control aperture 289 extends through the housing 268 and is in fluid communication with the second chamber 278 (shown in FIG. 3).

Referring to FIG. 4, the first control passage 284 is in fluid communication with the first valve body 276 through the first control aperture 287 (shown in FIG. 2), and with the first intake valve feed passage 260A formed in the cylinder head 212, which is aligned with the first control passage 284 when the housing 268 is bolted to the cylinder head 212. The first control passage 284 also aligns with a first exhaust valve feed passage 260B provided in the cylinder head 212. The second control passage 286 is in fluid communication with the second valve body 280 through the second control aperture 289 (shown in FIG. 2), and is also in fluid communication with the second intake valve feed passage 261A and a second exhaust valve feed passage 261B, both of which are provided in the cylinder head 212.

The cylinder assembly 214 is an overhead cam-type with an intake camshaft (not shown) that rotates about an intake camshaft axis 224 and an exhaust camshaft (not shown) that rotates about an exhaust camshaft axis 226. The cylinder head 212 partially forms four cylinders indicated schematically by upper ends thereof. The cylinders include a first cylinder 212A, a second cylinder 212B, a third cylinder 212C and a fourth cylinder 212D. The first intake feed passage 260A routes through the cylinder head 212 to the vicinity of the first and second cylinders 212A, 212B to provide hydraulic fluid to a plurality of hydraulic lash adjusters positioned to support lift of engine inlet valves as described with respect to the valve train, including hydraulic lash adjuster 32, SRFF assembly 30 and engine inlet valve 36, of FIG. 1.

The second intake valve feed passage 261A is routed through the cylinder head 212 to allow fluid communication with a plurality of hydraulic lash adjusters positioned to support lift of engine inlet valves for cylinders 3 and 4, 212C and 212D, respectively.

Similarly, the first exhaust feed passage 260B routes through the cylinder head 212 to provide hydraulic fluid to a plurality of lash adjusters positioned to support lift of engine exhaust valves located at cylinders 1 and 2, 212A, 212B, respectively. The second exhaust feed passage 261B routes through the cylinder head 212 to allow fluid communication with a plurality of lash adjusters positioned to support lift of engine exhaust valves at cylinders 212C and 212D. Cylinders 1 and 2 are a first set of cylinders having a first set of hydraulic lash adjusters (either for engine intake valves or engine exhaust valves) associated therewith. Cylinders 3 and 4 are a second set of cylinders having a second set of hydraulic lash adjusters (either for engine intake valves or engine exhaust valves) operatively associated therewith and connected thereto.

As shown in FIG. 4, the first and second solenoid valve bodies 276, 280 are positioned between the fluid supply passage 292 and the respective first and second control passages 284, 286 to partially block fluid flow to the respective chambers 274, 278 (shown in FIG. 3), thus permitting only a first, relatively low level of hydraulic fluid flow and associated pressure to the respective control passages 284, 286. Accordingly, when controlled to be in such a position, the valve bodies 276 and 280 allow only a first level of fluid flow to the respective hydraulic lash adjusters of the first and second cylinders sets 212A-212B, 212C-212D, respectively. However, an electronic control unit (not shown) controls the solenoid valves 270, 272 to allow the valve bodies 276, 280 to translate within the chambers 274, 278 so that a greater level of fluid pressure, and thus fluid flow, is provided from the supply passage 292 to the respective first and second control passages 284, 286. Those skilled in the art will readily understand the use of an electronic control unit to shift the force of a solenoid valve body to change fluid pressure permitted past the valve body. It should be appreciated that the solenoid valves 270, 272 may be controlled separately from one another to allow a low pressure or high pressure flow situation independently of the other valve. Alternatively, the solenoid valves 270, 272 may be controlled to simultaneously switch from low flow to high flow, or vice versa. Thus, by controlling the solenoid valves 270, 272 fluid flow and associated pressure to the respective cylinder sets 212A-212B, 212C-212D is controlled to allow a low lift or high lift of associated engine inlet valves or exhaust valves of each respective set. A single hydraulic circuit module 210 thus controls inlet and exhaust valves on four cylinders.

According to a preferred embodiment of the present invention, there are two intake valves (such as the intake valve 36 of FIG. 1) and two exhaust valves (such as the exhaust valve 66 of FIG. 1) for each of the cylinders 212A, 212B, 212C, and 212D. Therefore, there are two hydraulic lash adjusters (such as the lash adjuster 32 of FIG. 1) for the intake valves and two hydraulic lash adjusters for the exhaust valves of each cylinder 212A, 212B, 212C, and 212D. It should be appreciated that this configuration is preferred and will therefore be described in detail; but that alternate configurations may also be envisioned.

Figure 5:
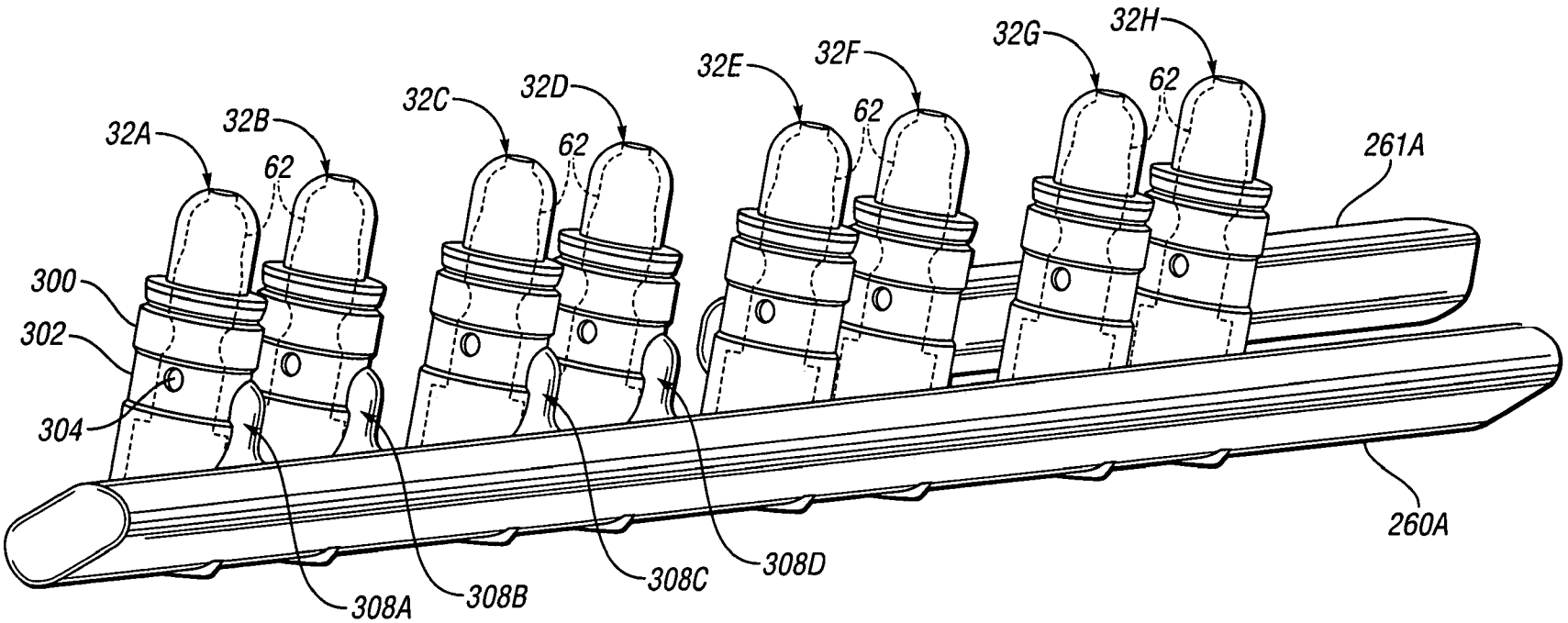
FIG. 5 is a schematic perspective illustration of two valve feed passages defined by the engine assembly of FIG. 4 in fluid communication with a plurality of hydraulic lash adjusters.

Referring to FIG. 5, the first intake valve feed passage 260A and the second intake valve feed passage 261A are shown in fluid communication with a plurality of lash adjusters 32A, 32B, 32C, 32D, 32E, 32F, 32G and 32H. According to the preferred embodiment, the first intake valve feed passage 260A is operatively associated with the lash adjusters 32A, 32B, 32C, and 32D, and the second intake valve feed passage 261A is operatively associated with the lash adjusters 32E, 32F, 32G, and 32H. The feed passages 260A and 261A are shown as solid for illustrative purposes; however, as previously indicated, these passages are actually hollow cavities defined by the cylinder head 212 (shown in FIG. 4). The lash adjusters 32A-32H represent the lash adjusters for the intake valves of the cylinders 212A-212D. Therefore, each of the lash adjusters 32A-32H is operatively connected to a SRFF assembly 30 and an engine inlet valve 36 in the manner described hereinabove with respect to the lash adjuster 32 of FIG. 1.

The lash adjusters 32A and 32B are operatively associated with the first cylinder 212A (shown in FIG. 4). Similarly, the lash adjusters 32C and 32D are operatively associated with the second cylinder 212B (shown in FIG. 4), the lash adjusters 32E and 32F are operatively associated with the third cylinder 212C (shown in FIG. 4), and the lash adjusters 32G and 32H are operatively associated with the fourth cylinder 212D (shown in FIG. 4).

The lash adjusters 32A-32H each include a body 300 defining an annular recessed portion 302 configured to transfer hydraulic fluid to an intake port 304. The intake ports 304 of each lash adjuster 32A-32H is in fluid communication with the chamber 62 within each lash adjuster. Therefore, for each of the lash adjusters 32A-32H, hydraulic fluid from the first or second valve feed passages 260A, 261A is transferable into the annular recessed portion 302, through the intake port 304, and into the chamber 64. Hydraulic fluid in the chamber 64 of one of the lash adjusters 32A-32H is then transferrable through the channel 64 (shown in FIG. 1) to control a respective SRFF assembly 30 (shown in FIG. 1) and thereby select the amount of valve lift in the manner described hereinabove with respect to FIG. 1.

The first intake valve feed passage 260A is adapted to feed only the lash adjusters 32A-32D operatively associated with the cylinder set 212A-212B, and the second intake valve feed passage 261A is adapted to feed only the lash adjusters 32E-32H operatively associated with the cylinder set 212C-212D. As the solenoid valves 270 and 272 independently control fluid transfer to the feed passages 260A and 261A, respectively, the valve lift for the cylinder set 212A-212B and the valve lift for the cylinder set 212C-212D can be independently controlled. As an example, the cylinders 212A-212B can have high valve lift while the cylinders 212C-212D have low valve lift, and vice versa.

Independent control of the lash adjusters 32A-32D operatively associated with the cylinder set 212A-212B, and the lash adjusters 32E-32H operatively associated with the cylinder set 212C-212D is obtained in the following manner. The second intake valve feed passage 261A is adapted to transfer hydraulic fluid to the lash adjusters 32H, 32G, 32F and 32E, in that order. The second intake valve feed passage 261A does not extend beyond the lash adjuster 32E so that none of the hydraulic fluid in the feed passage 261A is transferable to the lash adjusters 32A-32D. It should be appreciated by one skilled in the art that the independent control of the lash adjusters 32A-32D operatively associated with the cylinder set 212A-212B, and the lash adjusters 32E-32H operatively associated with the cylinder set 212C-212D, can provide a larger switching time window for the SRFF assemblies.

As shown in FIGS. 1 and 5, the first intake valve feed passage 260A passes by but does not feed lash adjusters 32E-32H operatively associated with the cylinder set 212C-212D. More precisely, the body 300 of each lash adjuster 32E-32H fits into the cylinder head 212 such that the first intake valve feed passage 260A is partially blocked or plugged and therefore does not reach the annular recessed portion 302 of the lash adjusters 32E-32H. Accordingly, the lash adjusters 32E-32H are not fed by the first intake valve feed passage 260A even though the first intake valve feed passage 260A passes by and comes into contact with the body 300 of the lash adjusters 32E-32H. By implementing the body 300 of the lash adjusters 32E-32H to plug the first intake valve feed passage 260A in this manner, the first intake valve feed passage 260A and the second intake valve feed passage 261A can be located within very close proximity to each other thereby providing a compact valve feed passage design and allowing both passages to be formed with a single casting core.

Referring to FIG. 5, the cylinder head 212 (shown in FIG. 4) defines a plurality of worm tracks 308A, 308B, 308C, and 308D, in fluid communication with the first intake valve feed passage 260A. For purposes of the present invention, the worm tracks 308A, 308B, 308C, and 308D are short channels which may be formed in any known manner. The worm tracks 308A, 308B, 308C, and 308D are shown as solid for illustrative purposes; however, it should be appreciated that these passages are actually hollow cavities defined by the cylinder head 212. The worm tracks 308A, 308B, 308C, and 308D are adapted to transfer hydraulic fluid from the first intake valve feed passage 260A to the intake port 304 of the lash adjusters 32A, 32B, 32C and 32D, respectively.

Eight additional hydraulic lash adjusters (not shown) in fluid communication with the first exhaust valve feed passage 260B and the second exhaust valve feed passage 261B are also preferably provided. The additional hydraulic lash adjusters are for the exhaust valves (such as the exhaust valve 66 of FIG. 1) of the cylinders 212A-212D. The additional hydraulic lash adjusters function similarly to the hydraulic lash adjusters 32A-32H and therefore will not be described in detail.

While the best modes for carrying out the invention have been described in detail, those familiar with the art to which this invention relates will recognize various alternative designs and embodiments for practicing the invention within the scope of the appended claims.

The invention claimed is:

1. An engine assembly comprising:

a cylinder head at least partially forming a plurality of cylinders;

first and second sets of hydraulic lash adjusters operatively connected to first and second sets of said cylinders, respectively, and responsive to a variation in hydraulic fluid pressure to cause a variation in lift of first and second sets of engine valves respectively operatively connected thereto, said first and second sets of hydraulic lash adjusters including a body and an inlet portion;

a first feed passage defined by said cylinder head, said first feed passage in fluid communication with said first set of hydraulic lash adjusters; and a second feed passage defined by said cylinder head, said second feed passage in fluid communication with said second set of hydraulic lash adjusters;

wherein the valve lift of the first set of engine valves is independently variable by controlling the pressure of hydraulic fluid in the first feed passage, and the valve lift of the second set of engine valves is independently variable by controlling the pressure of hydraulic fluid in the second feed passage; and wherein the second feed passage is partially blocked by the first set of hydraulic lash adjusters such that hydraulic fluid transferred through the second feed passage engages the body of the first set of hydraulic lash adjusters without entering the inlet portion of the first set of hydraulic lash adjusters.

2. The engine assembly of claim 1, wherein the first and second feed passages are located in close proximity to each other.

3. The engine assembly of claim 1, further comprising:

third and fourth sets of hydraulic lash adjusters operatively connected to said first and second sets of said cylinders, respectively, and responsive to a variation in hydraulic fluid pressure to cause a variation in lift of third and fourth sets of engine valves respectively operatively connected thereto;

a third feed passage defined by said cylinder head, said third feed passage in fluid communication with said third set of hydraulic lash adjusters; and a fourth feed passage defined by said cylinder head, said fourth feed passage in fluid communication with said fourth set of hydraulic lash adjusters;

wherein the valve lift of the third set of engine valves is independently variable by controlling the pressure of hydraulic fluid in the third feed passage, and the valve lift of the fourth set of engine valves is independently variable by controlling the pressure of hydraulic fluid in the fourth feed passage.

4. The engine assembly of claim 3, further comprising a plurality of worm tracks defined by the cylinder head, said plurality of worm tracks disposed between the fourth feed passage and the fourth set of hydraulic lash adjusters to establish fluid communication therebetween.

5. The engine assembly of claim 3, wherein said third and fourth sets of hydraulic lash adjusters include a body and an inlet portion.

6. The engine assembly of claim 5, wherein the fourth feed passage is partially blocked by the third set of hydraulic lash adjusters such that hydraulic fluid transferred through the fourth feed passage engages the body of the third set of hydraulic lash adjusters without entering the inlet portion of the third set of hydraulic lash adjusters.

7. The engine assembly of claim 5, further comprising a plurality of worm tracks defined by the cylinder head, said plurality of worm tracks disposed between the second feed passage and the second set of hydraulic lash adjusters to establish fluid communication therebetween.

8. An engine assembly comprising:

a cylinder head at least partially forming a plurality of cylinders;

first and second sets of hydraulic lash adjusters operatively connected to first and second sets of said cylinders, respectively, and responsive to a variation in hydraulic fluid pressure to cause a variation in lift of first and second sets of engine valves respectively operatively connected thereto, said first and second sets of hydraulic lash adjusters including a body and an inlet portion;

a first feed passage defined by said cylinder head, said first feed passage in fluid communication with said first set of hydraulic lash adjusters; and a second feed passage defined by said cylinder head, said second feed passage in fluid communication with said second set of hydraulic lash adjusters; and a plurality of worm tracks defined by the cylinder head, said plurality of worm tracks disposed between the second feed passage and the second set of hydraulic lash adjusters to establish fluid communication therebetween;

wherein the valve lift of the first set of engine valves is independently variable by controlling the pressure of hydraulic fluid in the first feed passage, and the valve lift of the second set of engine valves is independently variable by controlling the pressure of hydraulic fluid in the second feed passage.

9. The engine assembly of claim 8, wherein the second feed passage is partially blocked by the first set of hydraulic lash adjusters such that hydraulic fluid transferred through the second feed passage engages the body of the first set of hydraulic lash adjusters without entering the inlet portion of the first set of hydraulic lash adjusters.

10. The engine assembly of claim 8, further comprising: third and fourth sets of hydraulic lash adjusters operatively connected to said first and second sets of said cylinders, respectively, and responsive to a variation in hydraulic fluid pressure to cause a variation in lift of third and fourth sets of engine valves respectively operatively connected thereto;

a third feed passage defined by said cylinder head, said third feed passage in fluid communication with said third set of hydraulic lash adjusters; and a fourth feed passage defined by said cylinder head, said fourth feed passage in fluid communication with said fourth set of hydraulic lash adjusters;

wherein the valve lift of the third set of engine valves is independently variable by controlling the pressure of hydraulic fluid in the third feed passage, and the valve lift of the fourth set of engine valves is independently variable by controlling the pressure of hydraulic fluid in the fourth feed passage.

11. The engine assembly of claim 10, further comprising a second plurality of worm tracks defined by the cylinder head, said second plurality of worm tracks disposed between the fourth feed passage and the fourth set of hydraulic lash adjusters to establish fluid communication therebetween.

12. The engine assembly of claim 10, wherein said third and fourth sets of hydraulic lash adjusters include a body and an inlet portion.

13. The engine assembly of claim 12, wherein the fourth feed passage is partially blocked by the third set of hydraulic lash adjusters such that hydraulic fluid transferred through the fourth feed passage engages the body of the third set of hydraulic lash adjusters without entering the inlet portion of the third set of hydraulic lash adjusters.

14. A method for independently controlling the valve lift of a first and second set of engine valves comprising:

providing first and second sets of hydraulic lash adjusters operatively connected to the first and second set of engine valves, said first and second sets of hydraulic lash adjusters including a body and an inlet portion;

applying a first predetermined amount of hydraulic pressure to said first set of hydraulic lash adjusters via a first feed passage to thereby control the valve lift of the first set of engine valves;

applying a second predetermined amount of hydraulic pressure to said second set of hydraulic lash adjusters via a second feed passage to thereby control the valve lift of the second set of engine valves independently from the valve lift of the first set of engine valves; and implementing the first set of hydraulic lash adjusters to partially block the second feed passage such that the hydraulic fluid transferred through the second feed passage engages the body of the first set of hydraulic lash adjusters without entering the inlet portion of the first set of hydraulic lash adjusters thereby allowing the first and second feed passages to be positioned in close proximity to each other while retaining independent valve lift control of the first and second sets of engine valves.

* * * * *